US006007400A

United States Patent [19]

Lan

[11] Patent Number: 6,007,400

[45] Date of Patent: Dec. 28, 1999

[54] CONVERTIBLE TOY CHAIR

[76] Inventor: Red Lan, 15F, No. 108, Sec. 1, Hsin Tai 5th Rd., Hsichih, Taipei Hsien, Taiwan

[21] Appl. No.: 09/288,095

[22] Filed: Apr. 7, 1999

[51] Int. Cl.[6] ..... A63H 33/00

[52] U.S. Cl. ..... 446/71; 446/491

[58] Field of Search ..... 446/29, 71, 491, 446/92; 280/647, 648; 297/16.1, 181, 19, DIG. 11

[56] References Cited

U.S. PATENT DOCUMENTS

| | | | |
|---|---|---|---|
| 2,812,943 | 11/1957 | Harter | 446/29 |
| 3,955,307 | 5/1976 | Payton | 446/92 |
| 5,460,430 | 10/1995 | Miga, Jr. et al. | 297/DIG. 11 |
| 5,887,945 | 3/1999 | Sedlack | 297/DIG. 11 |

*Primary Examiner*—Sam Rimell

*Attorney, Agent, or Firm*—Ladas & Parry

[57] ABSTRACT

A toy chair includes a seat member having a horizontal seat portion and a vertical backrest portion that extends upwardly from the rear edge of the seat portion. A pair of extension members extend respectively from left and right lateral sides of the seat member. Left and right connecting members are mounted respectively on the extension members of the seat member. Each of the connecting members is formed with at least two positioning recesses that are aligned in a longitudinal direction thereof. Left and right height adjustment mechanisms are mounted respectively on the connecting members so as to be slidable in the longitudinal direction. Each of the height adjustment mechanisms is provided with a retainer that is operable to engage removably a selected one of the positioning recesses in the respective one of the left and right connecting members. Front and rear leg units have upper portions connected to the height adjustment mechanisms, and lower portions to be placed on a ground surface.

19 Claims, 8 Drawing Sheets

CONVERTIBLE TOY CHAIR

FIELD OF THE INVENTION

The invention relates to a toy, more particularly to a toy chair for dolls and which can be easily converted into other types of toys.

BACKGROUND OF THE INVENTION

Some toys, such as a toy bed and a toy stroller, are designed to have a realistic appearance. However, a toy chair that can be easily converted into other types of toys is not yet available in the market.

SUMMARY OF THE INVENTION

The main object of this invention is to provide a toy chair which is easily convertible into other types of toys and which can be used when playing with dolls.

Accordingly, a toy chair of the present invention includes a seat member, elongated left and right connecting members, left and right height adjustment mechanisms, and front and rear leg units. The seat member has a horizontal seat portion with a rear edge, and a vertical backrest portion that extends upwardly from the rear edge of the seat portion. The seat member further has left and right lateral sides, and a pair of extension members that extend respectively from the left and right lateral sides. The elongated left and right connecting members are mounted respectively on the extension members of the seat member. Each of the left and right connecting members is formed with at least two positioning recesses that are aligned in a longitudinal direction of the corresponding one of the left and right connecting members. The height adjustment mechanisms are mounted respectively on the left and right connecting members so as to be slidable in the longitudinal direction of the respective one of the left and right connecting members. Each of the left and right height adjustment mechanisms is provided with a retainer that is operable so as to engage removably a selected one of the positioning recesses in the respective one of the left and right connecting members. The front and rear leg units have upper portions connected to the left and right height adjustment mechanisms, and lower portions adapted to be placed on a ground surface.

BRIEF DESCRIPTION OF THE DRAWINGS

Other features and advantages of this invention will become more apparent in the following detailed description of the preferred embodiment of this invention, with reference to the accompanying drawings, in which:

FIG. 3 (A) is a sectional side view of the height adjustment mechanism and the connecting member of the preferred embodiment;

DETAILED DESCRIPTION OF THE PREFERRED EMBODIMENT

Figure 1:
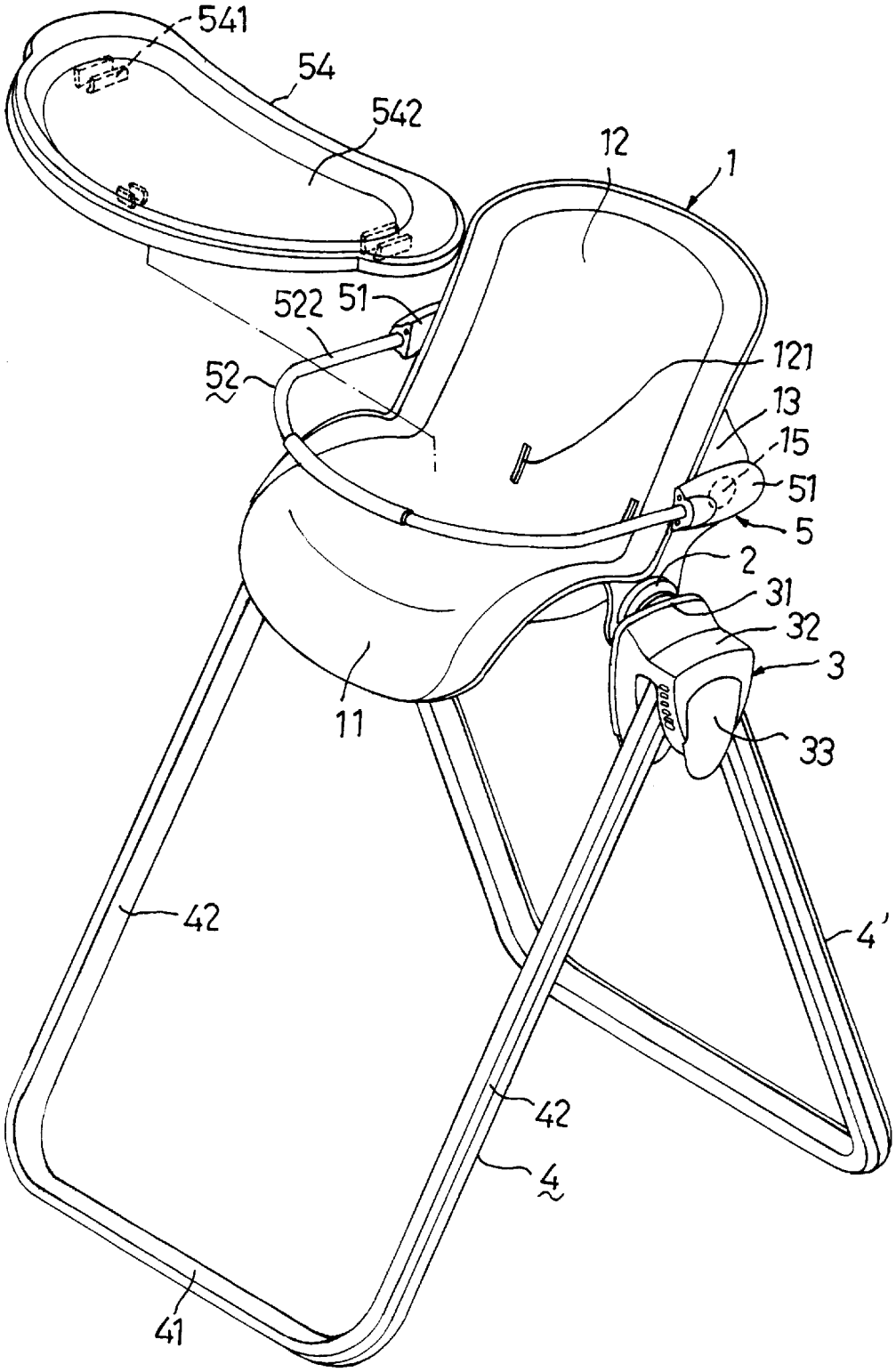
FIG. 1 is a partly exploded and perspective view of a preferred embodiment of a convertible toy chair according to this invention.
Figure 2:
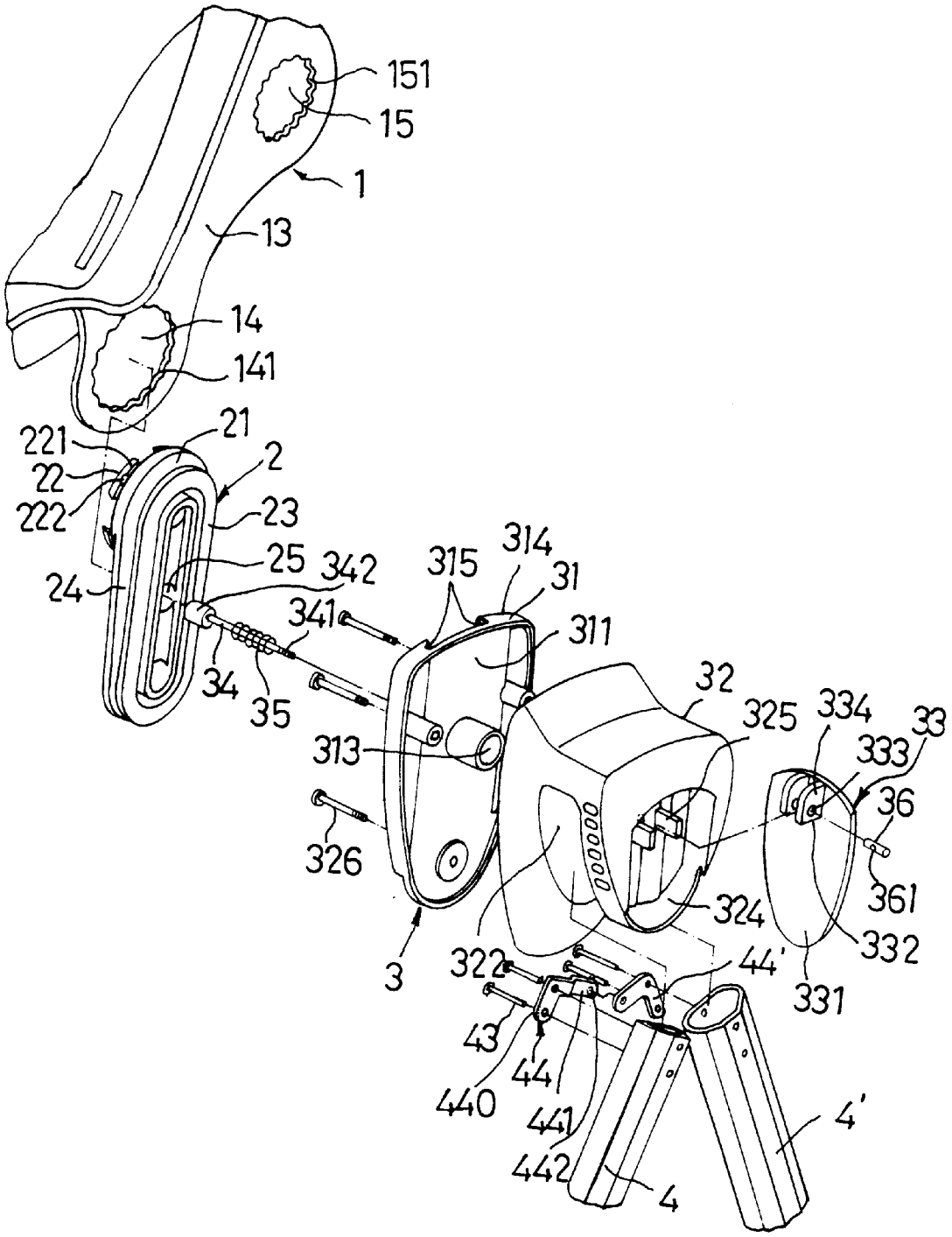
FIG. 2 is a fragmentary exploded view of a connecting member and a height adjustment mechanism of the preferred embodiment.
Figure 3:
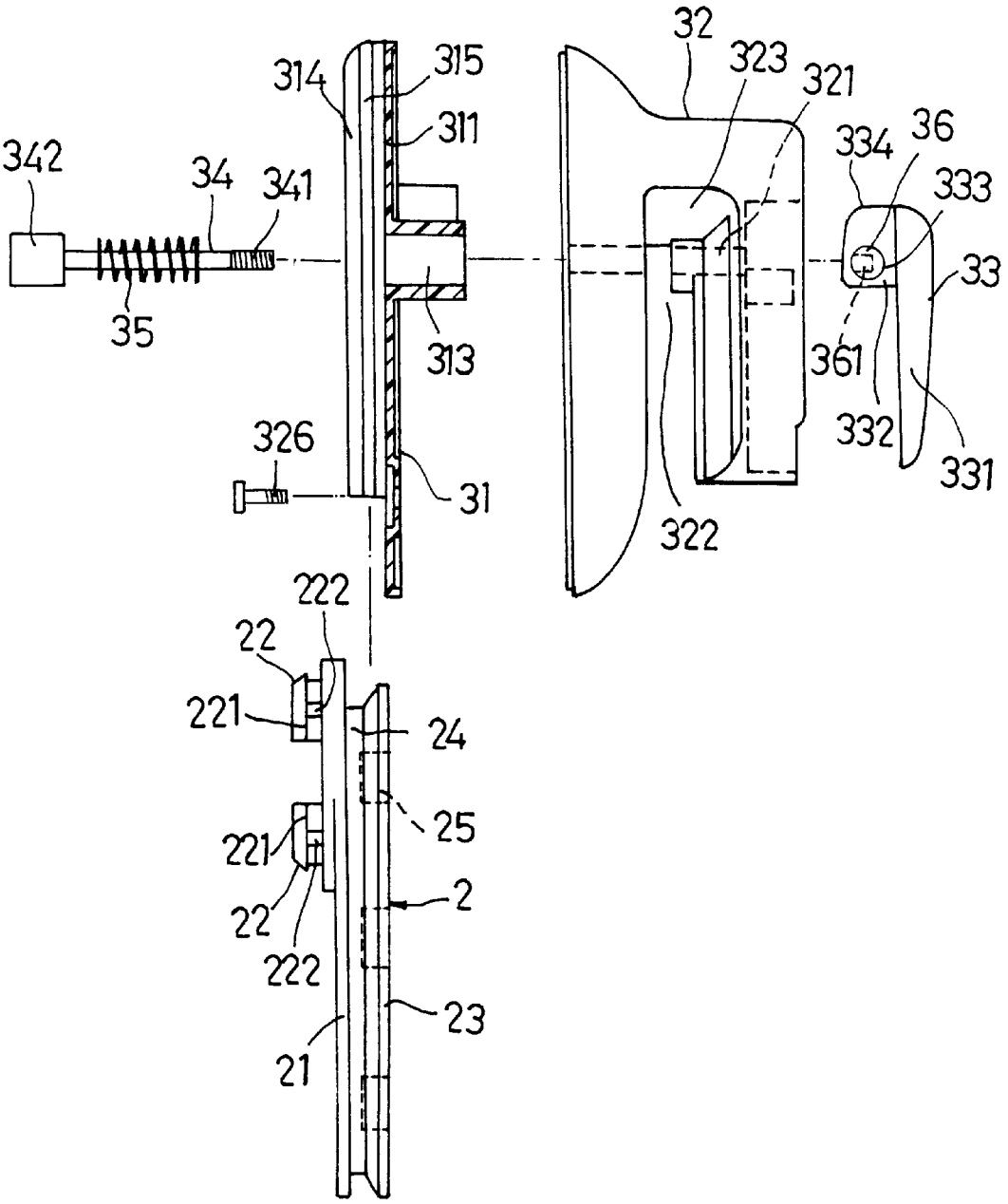
FIG. 3 is an exploded partly sectional side view of the height adjustment mechanism and the connecting member of the preferred embodiment.
Figure 3A:
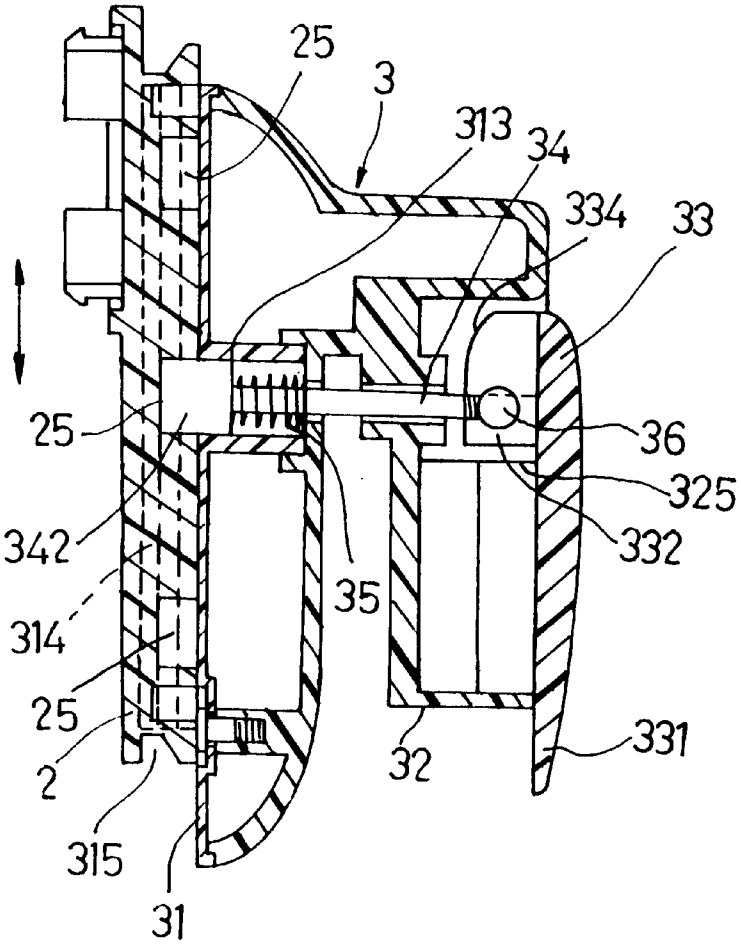

Referring to FIGS. 1, 2, 3 and 3 (A), the preferred embodiment of a toy chair according to the present invention is shown to include a seat member 1, elongated left and right connecting members 2, left and right height adjustment mechanisms 3, front and rear leg units 4, 4', and a tray mechanism 5.

As illustrated, the seat member 1 has a horizontal seat portion 11 with a rear edge, and a vertical backrest portion 12 that extends upwardly from the rear edge of the seat portion 11. Preferably, the backrest portion 12 is formed with two spaced mounting holes 121 for mounting a seat cushion (not shown) thereon. The seat member 1 further has a pair of extension members 13 that extend rearwardly and respectively from the left and right lateral sides of the backrest portion 12. Each of the extension members 13 is formed with lower and upper retaining holes 14, 15. Each of the retaining holes 14, 15 has an inner periphery formed with an annular series of retaining teeth 141, 151.

The connecting members 2 are mounted respectively on the extension members 13. Each of the connecting members 2 includes a plate body 21 which has three longitudinally aligned positioning recesses 25, and a plurality of angularly spaced resilient hook projections 22 that are formed on an inner surface of the plate body 21 and that extend into the lower retaining hole 14 such that barb ends 221 of the hook projections 22 engage the edge of the retaining hole 14. Each of the hook projections 22 is further provided with a stop 222 that engages the retaining teeth 141 for retaining the seat member 1 at a desired inclination relative to the plate bodies 21. The plate body 21 further has a pair of longitudinally extending slide rails 23 formed on front and rear sides 24 thereof.

Each of the height adjustment mechanisms 3 includes a slide member 31 mounted on and slidable along the respective one of the plate bodies 21, a leg mounting seat 32 mounted securely on an outer surface 311 of the slide member 31 by means of fastener screws 326, and a retainer operably mounted on the leg mounting seat 32. The retainer includes a spring 35 loaded on a locking bolt 34, and an operating piece 33. Preferably, an inner surface 314 of the slide member 31 is formed with a pair of longitudinal slide grooves 315 to slidably receive the slide rails 23 of the plate body 21. The operating piece 33 includes an operating plate 331, a parallel pair of pivot lugs 332 extending from one side of the operating plate 331 toward the leg mounting seat 32, and a connecting rod 36 that extends through aligned openings 333 in the pivot lugs 332. The threaded distal end 341 of the locking bolt 34 is inserted through a hole 321 in the leg mounting seat 32 and a bolt-head retention hole 313 of the slide member 31, and engages a radial screw hole 361 in the connecting rod 36. After assembly, the operating plate 331 is pivotable about the connecting rod 36 to a locking position, as best shown in FIG. 3 (A), where the locking bolt 34 is biased toward the slide member 31 so as to locate an enlarged head 342 of the locking bolt 34 in the selected one of the positioning recesses 25. Under such a condition, the plate body 21 is immobilized with respect to the slide member 31. Preferably, the outer surface of the leg mounting seat 32 is formed with an accommodating cavity 324 to receive the operating plate 331 when in the locking position. The cavity 324 has an innermost wall formed with a pair of stop plates 325 that have the pivot lugs 332 extending therebetween.

Figure 6:
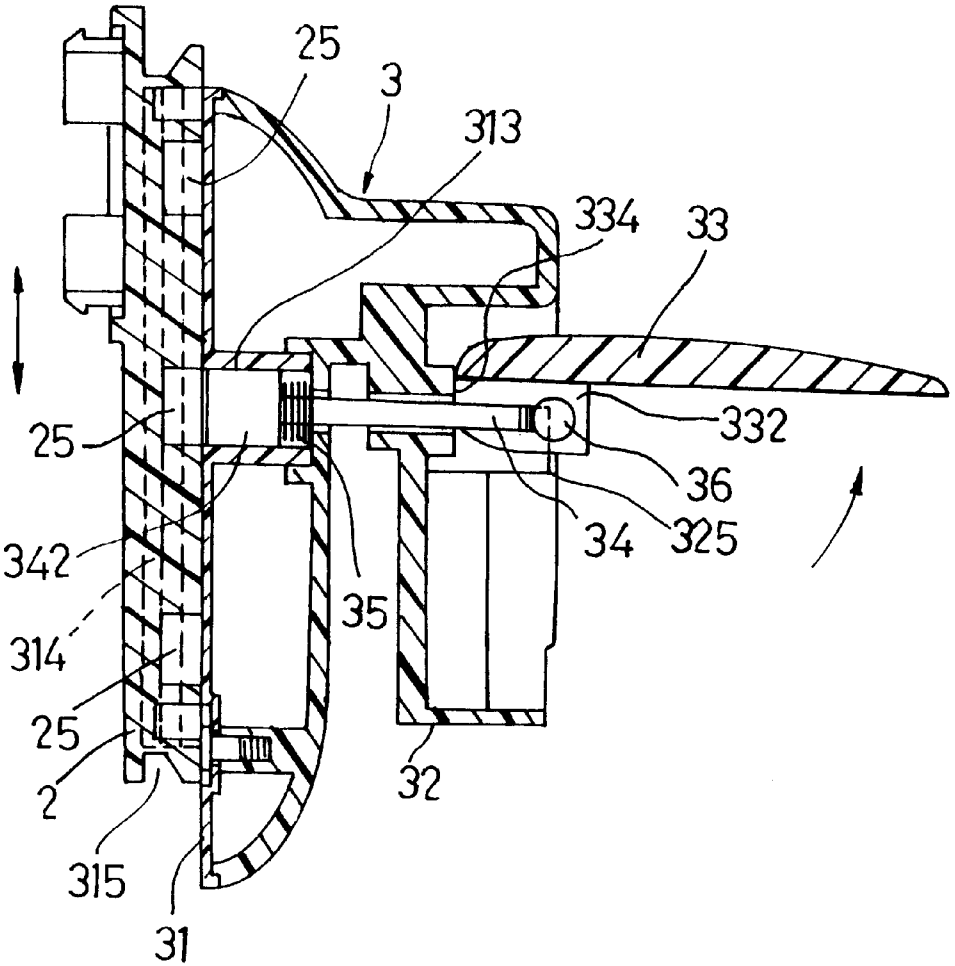
FIG. 6 is a sectional side view of the height adjustment mechanism and the connecting member used in the preferred embodiment, illustrating how the connecting member is slid relative to the height adjustment mechanism.

The operating plate 331 is pivotable about the connecting rod 36 to an unlocking position, as best shown in FIG. 6, where two abutment faces 334 of the pivot lugs 332 abut against the innermost wall of the cavity 324 such that the enlarged head 342 of the locking bolt 34 is fully pulled into the bolt-head retaining hole 313 of the slide member 31 against the action of the spring 35. Under this condition, the plate body 21 of the connecting member 2 is permitted to slide on the slide member 31 so as to alter the height of the seat member 1 relative to the slide member 31.

The leg mounting seat 32 of each of the height adjustment mechanisms 3 further has front and rear sides formed respectively with front and rear leg receiving spaces 322 that open downwardly. Lower portions 41 of the front and rear leg units 4, 4' are spread apart from each other. The upper portion of the front and rear leg units 4, 4' can be formed as a parallel pair of beams 42 with top edges that extend into the receiving spaces 322 of the leg mounting seats 32. The parallel beams 42 are pivoted to the leg mounting seats 32. Preferably, each of the front and rear leg receiving spaces 322 has an inclined top wall 323 that abuts against the top edges of the parallel beams 42 for retention of the front and rear leg units 4, 4' in a spread apart position (see FIGS. 1 and 7).

Figure 7:
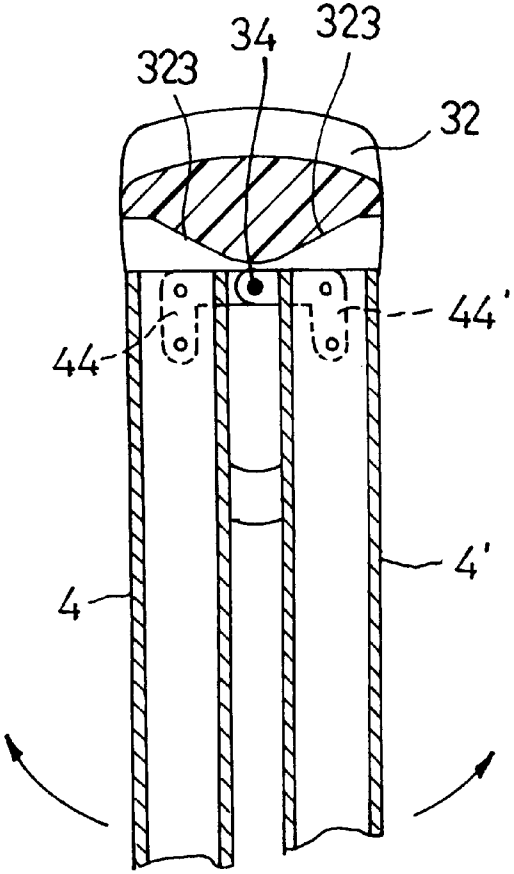
FIG. 7 is a fragmentary sectional view of the leg units of the preferred embodiment when folded.

In the preferred embodiment, each of the front and rear leg units 4, 4' further includes a pair of first pivot links 44 and a pair of second pivot links 44' (only one is shown in FIG. 1). Each of the first pivot links 44 has a first end 440 mounted securely on a respective one of the parallel beams 42 of the front leg unit 4 by rivets 43, and a second end 441 formed with a screw hole 442 via which the locking bolt 34 of the height adjustment mechanism 3 passes therethrough. The top edges of the parallel beams 42 of the front leg unit 4 are therefore mounted pivotally on the locking bolt 34. The top edges of the parallel beams 42 of the rear leg unit 4' are also mounted to the locking bolt 34 by the use of the second pivot links 44' which are mounted on the parallel beams 42 of the rear leg unit 4' in a manner similar to the front pivot links 44. When in the folded position, the top edges of the parallel beams 42 of the front and rear leg units 4, 4' will not abut against the corresponding inclined top wall 323 of the leg mounting seat 32, as best shown in FIG. 7.

Figure 4:
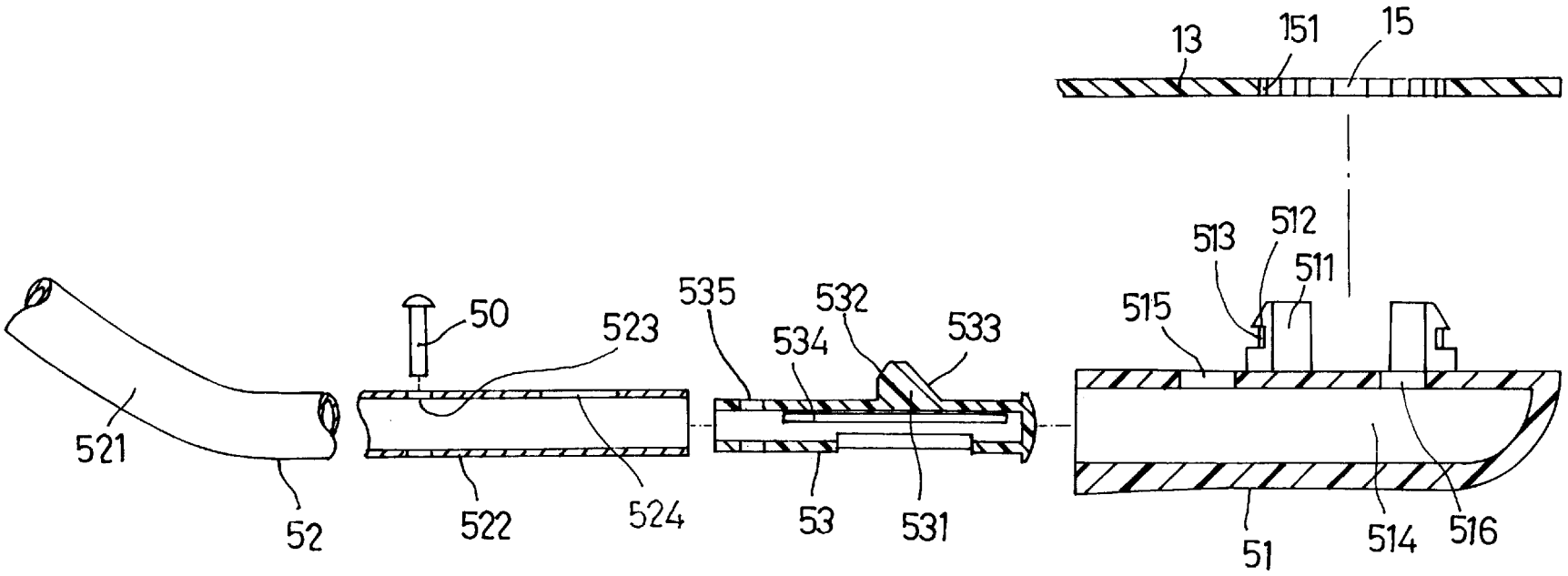
FIG. 4 is a fragmentary partly sectional view of a tray mechanism used in the preferred embodiment.
Figure 5:
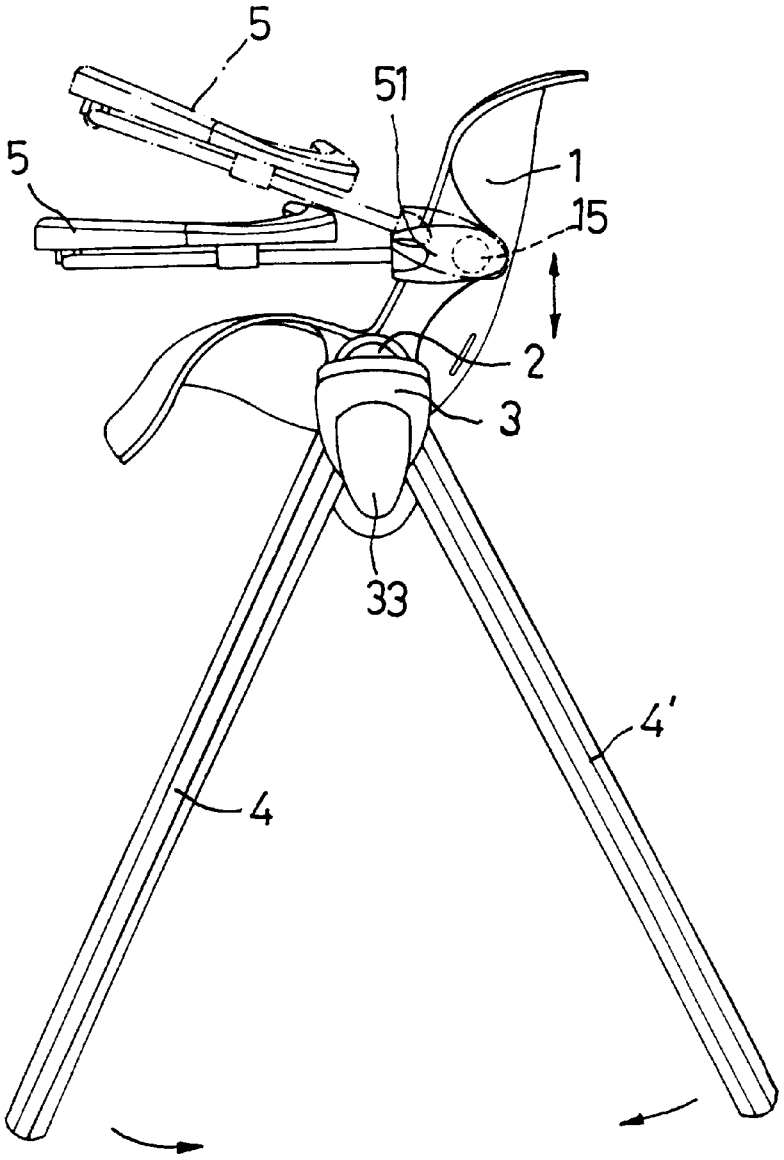
FIG. 5 illustrates how the tray mechanism and the leg units are angularly adjusted relative to a seat member of the preferred embodiment.

Referring to FIGS. 1 and 4, the tray mechanism 5 includes a pair of arm mounting seats 51, a U-shaped tray support 52, and a tray member 54. The tray member 54 has a plurality of downwardly open engagement members 541 that engage releasably the tray support 52. The tray member 54 is formed with a tray surface 542 for placing containers and the like thereon. The arm mounting seats 51 are rotatably and respectively mounted in the upper retaining holes 15 of the extension members 13. Each of the arm mounting seats 51 is formed with a plurality of angularly spaced resilient hook projections 511 that extend through the upper retaining hole 15 of the extension member 13 such that barb ends 512 of the hook projections 511 engage the edge of the upper retaining hole 15 such that the arm mounting seats 51 are angularly adjustable relative to the extension members 13, as shown in FIG. 5. Each of the hook projections 511 is also provided with a stop 513 that engages the retaining teeth 151 for retaining the arm mounting seats 51 at a desired inclination relative to the extension members 13. The arm mounting seat 51 is further formed with an axially extending insert hole 514 and two radial retaining holes 515, 516 that are aligned in an axial direction of the insert hole 514. The rear portion of the tray support 52 is formed as parallel rods 522 that are mounted telescopically into the insert holes 514 of the arm mounting seats 51. Each of the parallel rods 522 is provided with a plug member 53 that is extended slidably into the insert hole 514 of the respective one of the arm mounting seats 51. Preferably, the plug member 53 is formed with a resilient radial projection 531 that extends removably into a selected one of the radial retaining holes 515, 516 of the respective one of the arm mounting seats 51. The resilient radial projection 531 is provided with two opposite inclined faces 532, 533 to facilitate insertion and removal of the same relative to the radial retaining holes 515, 516 in the arm mounting seats 51. The plug member 53 is further formed with two axially extending slots 534 on opposed lateral sides of the radial projection 531 for enhanced resiliency during coupling with the parallel rod 522 at a radial opening 524 in the latter. A rivet 50 extends through the radial hole 523 of the rod 522 and a radial hole 535 of the plug member 53 to fasten the same together.

Figure 8:
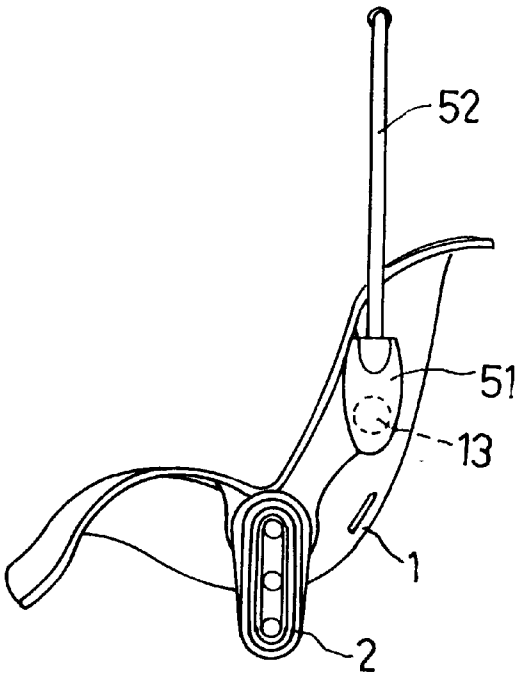
FIG. 8 illustrates how the preferred embodiment is converted into another type of toy after removal of the height adjustment mechanism and the leg unit from the seat member.

As illustrated in FIG. 8, after removal of the height adjustment mechanisms 3 and the leg units 4, 4' from the connecting members 2, and the tray member 54 from the tray support 52, the tray support 52 can be raised to a vertical position such that the preferred embodiment is converted into a toy cradle. When in the configuration of FIG. 8, the toy chair can be suspended from the ground by means of a rope or chain to serve as a swing.

With this invention thus explained, it is apparent that numerous modifications and variations can be made without departing from the scope and spirit of this invention. It is therefore intended that this invention be limited only as indicated in the appended claims.

I claim:

1. A convertible toy chair comprising:

a seat member having a horizontal seat portion with a rear edge, and a vertical backrest portion extending upwardly from said rear edge of said seat portion, said seat member having left and right lateral sides, and a pair of extension members that extend respectively from said left and right lateral sides;

elongated left and right connecting members mounted respectively on said extension members, each of said left and right connecting members being formed with at least two positioning recesses that are aligned in a longitudinal direction of corresponding one of said left and right connecting members;

left and right height adjustment mechanisms mounted respectively on said left and right connecting members so as to be slidable in the longitudinal direction of the respective one of said left and right connecting members, each of said left and right height adjustment mechanisms being provided with a retainer that is operable so as to engage removably a selected one of said positioning recesses in the respective one of said left and right connecting members; and front and rear leg units having upper portions connected to said left and right height adjustment mechanisms, and lower portions adapted to be placed on a ground surface.

2. The convertible toy chair as defined in claim 1, wherein each of said left and right height adjustment mechanisms includes a slide member mounted on and slidable along the respective one of said left and right connecting members, and a leg mounting seat mounted securely on said slide member, said upper portions of said front and rear leg units being connected to said leg mounting seats of said left and right height adjustment mechanisms, said retainer of each of said left and right height adjustment mechanisms including a spring-loaded locking bolt extending through said leg mounting seat and said slide member and engaging removably the selected one of said positioning recesses in the respective one of said left and right connecting members.

3. The convertible toy chair as defined in claim 2, wherein said retainer of each of said left and right height adjustment mechanisms further includes an operating piece mounted on one end of said locking bolt for pulling said locking bolt away from the respective one of said left and right connecting members.

4. The convertible toy chair as defined in claim 3, wherein said operating piece includes: an operating plate; a parallel pair of pivot lugs extending from one side of said operating plate toward said leg mounting seat, said pivot lugs being formed with aligned openings; and a connecting rod extending through said aligned openings in said pivot lugs, and formed with a radial screw hole to engage said one end of said locking bolt.

5. The convertible toy chair as defined in claim 2, wherein said slide member of each of said left and right height adjustment mechanisms is elongated in shape and is formed with a pair of slide grooves, each of said left and right connecting members being formed with a pair of slide rails for sliding engagement with said slide grooves in said slide member of the respective one of said left and right height adjustment mechanisms.

6. The convertible toy chair as defined in claim 1, wherein said extension members extend rearwardly from said backrest portion.

7. The convertible toy chair as defined in claim 1, wherein said left and right connecting members are mounted rotatably and respectively on said extension members.

8. The convertible toy chair as defined in claim 7, wherein each of said extension members is formed with a retaining hole, said retaining hole having an inner periphery formed with an annular series of retaining teeth, each of said left and right connecting members being formed with a plurality of angularly spaced resilient hook projections that extend through said retaining hole in the respective one of said extension members and that engage said retaining teeth for retaining releasably said seat member at a desired inclination relative to said left and right connecting members.

9. The convertible toy chair as defined in claim 2, wherein said leg mounting seat of each of said left and right height adjustment mechanisms has front and rear sides formed respectively with front and rear leg receiving spaces that open downwardly, said upper portion of each of said front and rear leg units being formed as a parallel pair of beams that extend into one of said front and rear leg receiving spaces of said leg mounting seats of said left and right height adjustment mechanisms and that are pivoted to said leg mounting seats of said left and right height adjustment mechanisms.

10. The convertible toy chair as defined in claim 9, wherein each of said parallel beams has a top edge, each of said front and rear leg receiving spaces having an inclining top wall that abuts against said top edges of said parallel beams for retention of said front and rear leg units in spread-apart positions.

11. The convertible toy chair as defined in claim 9, further comprising:

a pair of first pivot links, each of which having a first end mounted securely on a respective one of said parallel beams of said front leg unit, and a second end mounted pivotally on said locking bolt of one of said left and right height adjustment mechanism; and a pair of second pivot links, each of which having a first end mounted securely on a respective one of said parallel beams of said rear leg unit, and a second end mounted pivotally on said locking bolt of one of said left and right height adjustment mechanisms.

12. The convertible toy chair as defined in claim 1, further comprising a tray mechanism mounted on said extension members.

13. The convertible toy chair as defined in claim 12, wherein said tray mechanism includes:

a pair of arm mounting seats mounted respectively on said extension members;

a U-shaped tray support having a rear portion formed as parallel rods that are mounted respectively on said arm mounting seats; and a tray member mounted on said tray support.

14. The convertible toy chair as defined in claim 13, wherein said arm mounting seats are mounted rotatably and respectively on said extension members.

15. The convertible toy chair as defined in claim 14, wherein each of said extension members is formed with a retaining hole, said retaining hole having an inner periphery formed with an annular series of retaining teeth, each of said arm mounting seats being formed with a plurality of angularly spaced resilient hook projections that extend through said retaining hole in the respective one of said extension members and that engage said retaining teeth for retaining releasably said tray support at a desired inclination relative to said seat member.

16. The convertible toy chair as defined in claim 13, wherein said parallel rods are mounted telescopically and respectively on said arm mounting seats.

17. The convertible toy chair as defined in claim 16, wherein each of said arm mounting seats is formed with an axially extending insert hole and at least two radial retaining holes that are aligned in an axial direction of said insert hole, each of said parallel rods of said tray support being provided with a plug member that is extended slidably into said insert hole of the respective one of said arm mounting seats and that is formed with a resilient radial projection that extends removably into a selected one of said radial retaining holes in the respective one of said arm mounting seats.

18. The convertible toy chair as defined in claim 13, wherein said tray member is mounted removably on said tray support.

19. The convertible toy chair as defined in claim 18, wherein said left and right height adjustment mechanisms are mounted detachably on said left and right connecting members.

* * * * *